US006808120B2

(12) United States Patent
Oram et al.

(10) Patent No.: US 6,808,120 B2
(45) **Date of Patent: *Oct. 26, 2004**

(54) RAIL ANCHORING SPIKE

(75) Inventors: David Oram, Jacksonville, FL (US); David Michael Barry, Greenwood, MN (US)

(73) Assignee: Lewis Bolt & Nut Company, Wayzata, MN (US)

( * ) Notice: Subject to any disclaimer, the term of this patent is extended or adjusted under 35 U.S.C. 154(b) by 9 days.

This patent is subject to a terminal disclaimer.

(21) Appl. No.: 10/281,893

(22) Filed: Oct. 28, 2002

(65) Prior Publication Data

US 2003/0111543 A1 Jun. 19, 2003

Related U.S. Application Data

(63) Continuation-in-part of application No. 09/927,878, filed on Aug. 10, 2001, now Pat. No. 6,471,140.
(60) Provisional application No. 60/224,714, filed on Aug. 11, 2000.

(51) Int. Cl.[7] ..... E01B 9/00
(52) U.S. Cl. ..... 238/372; 238/366; 238/375; 411/453; 411/473; 411/399
(58) Field of Search ..... 238/372, 366, 238/375, 367, 373, 374; 411/453, 473, 399, 337, 367, 394, 454, 451.1, 451.4, 451.5, 484

(56) References Cited

U.S. PATENT DOCUMENTS

| | | | | |
|---|---|---|---|---|
| 59,434 A | | 11/1866 | Merrill | |
| 108,986 A | | 11/1870 | Dunn et al. | |
| 698,843 A | | 4/1902 | Miner | |
| 994,330 A | | 6/1911 | Morris | |
| 1,081,575 A | | 12/1913 | Braine | |
| 1,125,885 A | | 1/1915 | Rouxel | |
| 1,194,047 A | | 8/1916 | Lynch | |
| 1,380,423 A | | 6/1921 | Sessler | |
| 2,056,688 A | | 10/1936 | Peterka et al. | |
| 2,169,408 A | | 8/1939 | De Vellier | |
| 2,183,243 A | | 12/1939 | Meersteiner | |
| 2,256,401 A | | 9/1941 | Maze | |
| 2,327,556 A | | 8/1943 | Purinton | |
| 2,389,464 A | | 11/1945 | Snyder | |
| 2,401,967 A | | 6/1946 | Sandberg | |
| 2,605,670 A | | 8/1952 | Lacerda | |
| 2,787,186 A | | 4/1957 | Brogiotti | |
| 3,025,003 A | | 3/1962 | Fortune | |
| 3,367,576 A | | 2/1968 | Suermann | |
| 4,350,464 A | | 9/1982 | Brothers | |
| 4,653,244 A | * | 3/1987 | Farrell | 52/745.21 |
| 4,776,737 A | * | 10/1988 | Wollar | 411/38 |
| 5,024,038 A | * | 6/1991 | DePellegrini et al. | 52/700 |
| 5,160,085 A | | 11/1992 | Arnold et al. | |
| 5,332,153 A | | 7/1994 | Leibhard et al. | |
| 5,494,213 A | | 2/1996 | Mau | |
| 5,758,821 A | | 6/1998 | Wirthwein et al. | |
| 6,318,939 B1 | | 11/2001 | Avaux | |
| 6,371,709 B1 | | 4/2002 | Papafotiou et al. | |
| 6,471,140 B2 | * | 10/2002 | Barry et al. | 238/372 |

FOREIGN PATENT DOCUMENTS

| | | |
|---|---|---|
| DE | 3423997 | 1/1986 |

* cited by examiner

*Primary Examiner*—Mark T. Le
(74) *Attorney, Agent, or Firm*—Fish & Richardson P.C., P.A.

(57) ABSTRACT

An improved fastener for attaching metal to wood is particularly suited for use as a railroad spike for attaching a metal rail to a wooden tie. The improved spike is adapted for installation by either driving or screwing the spike into the tie. A plurality of flutes are adapted to engage with the tie, thereby preventing loosening of the spike. The spike may be used with or without a metal boss or fishplate to secure a metal rail to a wooden tie.

38 Claims, 4 Drawing Sheets

RAIL ANCHORING SPIKE

CROSS REFERENCE TO RELATED APPLICATIONS

This application claims priority from U.S. application Ser. No. 09/927,878, filed Aug. 10, 2001 and U.S. Provisional Application Serial No. 60/224,714, filed Aug. 11, 2000.

TECHNICAL FIELD

This invention relates to fasteners for attaching metal to wood, and more particularly to an improved railroad spike for attaching a metal rail to a wooden tie.

BACKGROUND

It is common in constructing tracks for trains to provide a rail or rails supported on cross ties formed of wood. The rails are commonly made of a metal such as steel, and are generally provided with mounting flanges. The mounting flanges are adapted to rest on metallic bearing plates, commonly referred to as tie plates or fishplates. The fishplates in turn rest on the wooden ties. It is common to employ spikes (i.e. cut spikes) for securing rails to ties. In the usual case, a spike is inserted in an opening or cavity in the fishplate and the spike shank is driven into the tie. The head of the spike is generally adapted to engage with the flange of the rail, thereby securing the rail to the tie. Alternatively, the fishplate may be equipped with a metal clip or boss that engages to the flange of the rail, and the head of the spike is adapted to engage with the fishplate to secure the rail to the tie.

After being in service for a short period of time, the ordinary spike often works loose from the tie due to the working action that occurs as the rail deflects under the load of passing trains and due to expansion and contraction of the wood fibers of the tie due to temperature, humidity and other environmental changes. Such loosening of the spike can necessitate replacement of the spike or other parts of the track assembly. Attempts to secure or anchor a spike by providing the shank with burrs, barbs, serrations or similar rough features adapted to engage with the wooden ties generally have proved unsatisfactory. Such spikes can be difficult to drive into a tie using manual or automated impact spike-driving methods. The rough feature may also chew or tear the wood fibers of the tie during installation, thereby causing damage to the tie.

In addition, after such spikes have been in service an appreciable length of time, they will have a tendency to work in the hole established in the tie by the spike shank. Working of the spike acts to enlarge the hole surrounding the shank and to damage the surrounding wood fibers, causing the spike to loosen over time. The enlarged hole may also permit water and other chemicals to enter the hole surrounding the spike shank, thereby further weakening the spike or the surrounding wood fibers. Removal of the spike usually causes additional damage to the tie; therefore, spike removal often requires replacement of the entire tie in order to ensure that the replacement spike will anchor the rail to the tie with sufficient holding power.

Spikes have been adapted with threaded shanks that can be screwed into the wooden tie. However, such spikes are difficult to install using manual or automated impact driving methods. Furthermore, such spikes generally require a pre-drilled hole in the tie to facilitate installation using rotary spike driving methods. Threaded spikes are also known to work loose under the load of passing trains. In an attempt to reduce working of spikes under load, attempts have been made to equip spikes with tabs or uniquely shaped shanks adapted to engage with the cavity of a fishplate, thereby locking the spike into engagement with the fishplate, reducing the tendency of the spike to work loose and damage the tie. Such spikes, however, are extremely difficult to install using automated impact spike-driving methods. In addition, such spikes can generally be used only in conjunction with a fishplate, and are extremely difficult to remove once locked into engagement with the fishplate.

The art continually searches for improved spikes suitable for use in securing a metal rail to a wooden tie. In particular, the art continues to search for spikes that exhibit a reduced tendency to work under the load of passing trains, for spikes that are readily removed and reinstalled without requiring replacement of the tie, and for spikes that are capable of installation using automated spike-driving methods.

SUMMARY

This invention relates generally to an improved fastener for attaching metal to wood. More specifically, in one aspect, the invention features an improved railroad spike for attaching a metal rail to a wooden tie. The improved spike is well-suited for use with automated spike-driving methods, and is adapted to engage with the wooden tie to prevent or reduce loosening of the spike due to working of the spike under the load of a passing train, or due to expansion or contraction of the wood fibers in response to changing environmental conditions.

The improved spike is provided with a head having a flange, a metal stand-off extending axially from the flange, a plurality of flutes extending axially from the stand-off, and a threaded shank extending axially from the flutes to a tapered tip. In an alternative embodiment, the spike is provided with a head having first and second flanges wherein the head may further include a spacer portion between the first and second flanges. In this alternative embodiment, the stand-off extends axially from the second flange. The flutes are adapted to engage with wood to lock the spike into engagement with the tie, thereby preventing the spike from working loose due to mechanical loads imposed by passing trains or due to the influence of the elements.

In one embodiment, the head of the spike comprises a generally polygonal projecting tool grip extending axially from the flange on the side opposite to the threaded shank, or in the embodiment having first and second flanges, extending axially from the first flange on the side opposite to the spacer portion. The tool grip is adapted for engagement with a wrench to enable rotary driving of the spike into the tie or removal of the spike using a rotary motion imparted to the tool grip.

In a variation of this embodiment, the spike head is adapted for use with impact spike-driving methods. The head of the spike is preferably hemispherical or dome shaped and is adapted to for use with manual or automated impact spike-driving methods. Preferably, the hemispherical head is adapted to deform slightly under impact driving, thereby preventing damage to the tool grip.

In another embodiment, the threads are adapted to facilitate driving of the spike into the wooden tie using impact or rotary spike-driving methods, and to permit easy removal of the spike using rotary spike removal methods.

In a preferred variation of this embodiment, the threaded shank is adapted to permit driving of the spike into the tie using an impact driving method, and to permit easy removal of the spike using a wrench or other rotary spike removal method. The threads are adapted to cause rotation of the spike into the tie during installation using automated or manual impact spike-driving methods. The threads are preferably adapted to screw the spike threads into the wooden tie when a force is applied to the head of the spike in a direction generally towards the spike tip.

In a preferred embodiment, the improved spike is used with a metal tie plate or fishplate to secure the rail to the tie. In this embodiment, the length of the stand-off must be adapted to ensure that the flutes are at least partially engaged with the wooden tie when the spike is driven into the tie. The tie plate or fishplate preferably comprises a metal boss or an elastic fastener that is adapted to engage with the flange of the rail, thereby securing the rail to the tie when the spike is driven into the tie.

In another aspect, the invention features an improved railroad track assembly. The assembly comprises a metal rail, a wooden tie, a metal tie plate adapted to engage the rail, and an improved spike of the present invention. The improved spike is driven into the tie. The spike is adapted to fasten the tie plate and the rail to the tie. The improved spike comprises a head having an annular flange, a stand-off extending axially from the flange, a plurality of flutes extending axially from the stand-off, and a shank extending axially from the flutes to form a tapered tip. The flutes are adapted to engage the wooden tie. The standoff has a length adapted to ensure that the flutes are at least partially embedded in the tie when the spike is used to fasten the tie plate and the rail to the tie.

In still another aspect, the invention features a method of using an improved railroad spike. An improved spike, a metal rail having a flange, a wooden tie and a metal fishplate having a cavity are provided. The improved spike is provided with a head having a flange, a metal stand-off extending axially from the flange, a plurality of flutes extending axially from the stand-off, and a threaded shank extending axially from the flutes to a tapered tip. The threads are adapted to facilitate driving of the spike into the wooden tie using impact or rotary spike-driving methods, and to permit easy removal of the spike using rotary spike removal methods.

In a preferred variation of this embodiment, an automated spike-driving method is used to drive the spike into the tie, thereby securing a metal rail to the wooden tie. Preferably, an automated impact spike-driving method is employed. In an alternative embodiment, a manual spike driving apparatus is used to drive the improved spike into the tie.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
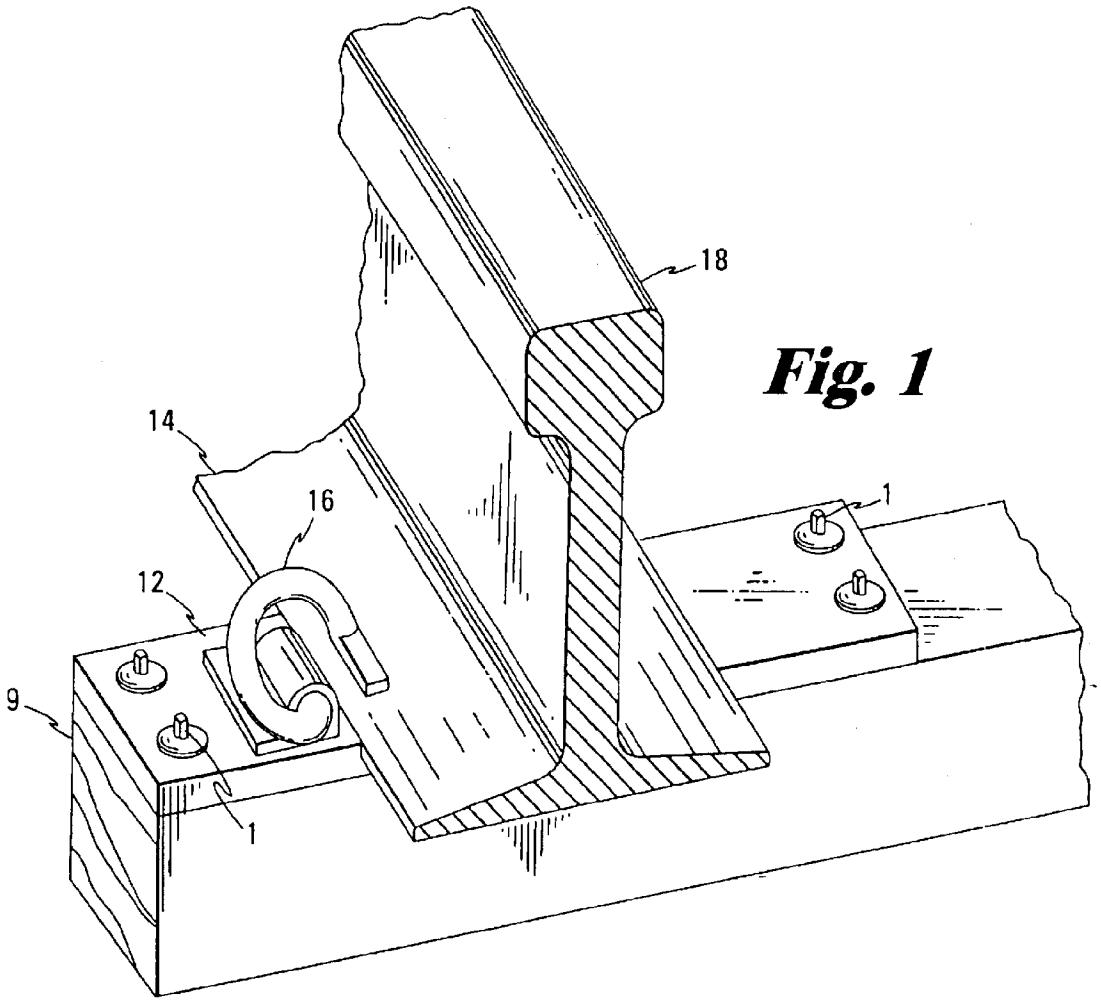
FIG. 1 is a perspective view of a typical metal to wood fastening application embodying the present invention.

FIG. 1 illustrates a perspective view of a typical metal to wood fastening application embodying the present invention. FIG. 1 illustrates the fastening of a metal rail 18 to a wooden tie 9 using the improved spike 1 of the present invention. In the illustrated embodiment, a metal tie plate or fishplate 12 comprising a boss or elastic fastener 16 engages with the flange 14 of rail 18. A plurality of spikes 1 are inserted into cavities in the fishplate 12, to secure the fishplate 12 and the rail 18 to the tie 9.

Figure 2:
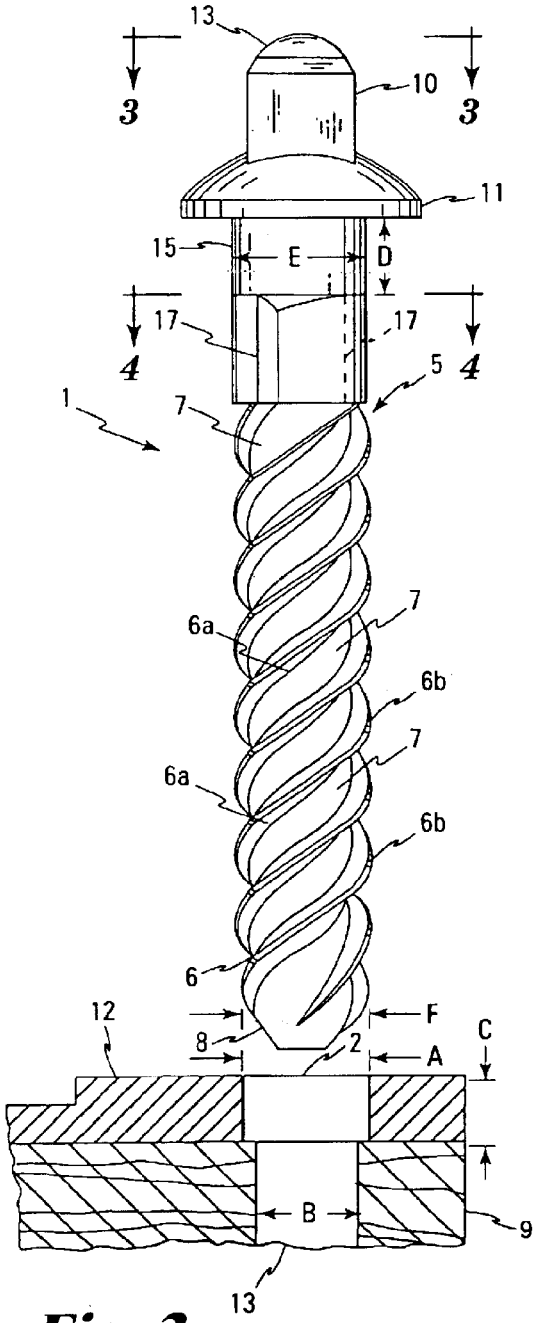
FIG. 2 is a side elevation view of a spike embodying the present invention.

FIG. 2 illustrates a side elevation view of the improved spike embodying the present invention. The spike has a head 10 having an annular flange 1, a stand-off 15 extending axially from the flange 11, a plurality of flutes 17 extending axially from the stand-off 15, a shank 5 extending axially from the flutes to form a tapered tip 8, and a plurality of pitched, helical, generally parallel threads 6 extending over at least a portion of the shank, running from the flutes 17 to the tip 8. The threads have an upper thread surface 6*b*, and a lower thread surface 6*a*.

Figure 6:
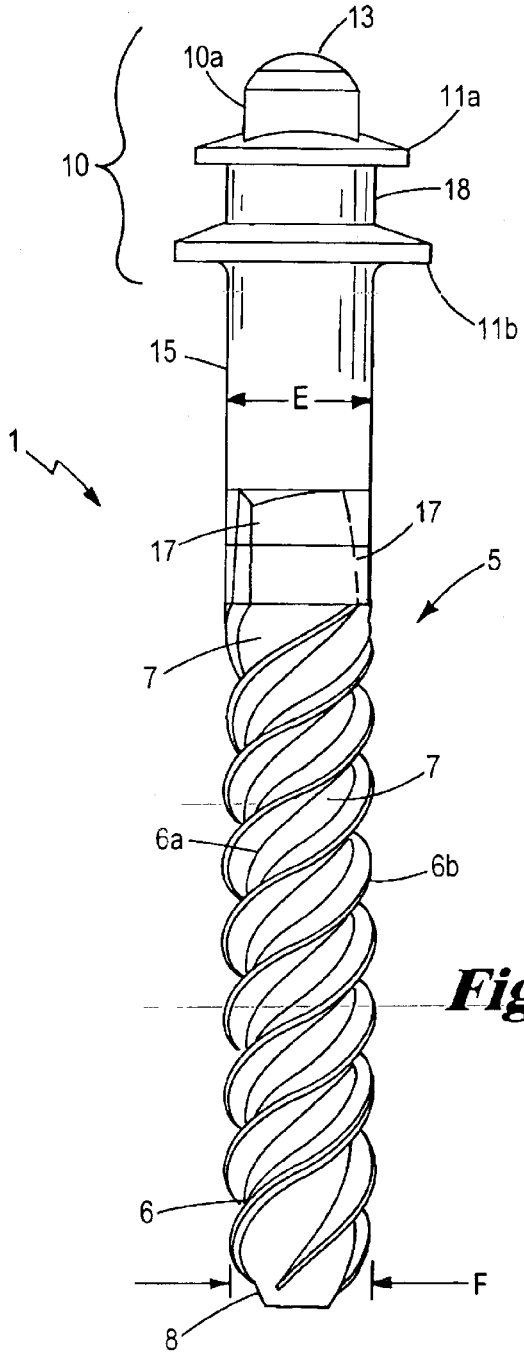
FIG. 6 is a side elevation view of a spike embodying the present invention.
Figure 7:
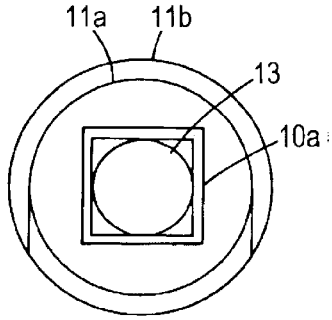
FIG. 7 is a top plan view of a spike embodying the present invention.

FIG. 6 illustrates a side elevation view of an alternative embodiment of the improved spike. The spike has a head 10 having first and second annular flanges 11*a* and 11*b*, respectively. The first and second annular flanges 11*a* and 11*b* are axially spaced by spacer portion 18. The diameter of second annular flange 11*b* is preferably greater than the diameter of first annular flange 11*a*. This embodiment further comprises a stand-off 15 extending axially from the second flange 11*b*, a plurality of flutes 17, a shank 5 extending axially from the flutes to form a tapered tip 8, and a plurality of pitched, helical, generally parallel threads 6 extending over at least a portion of the shank, running from the flutes 17 to the tip 8, with the threads having upper and lower thread surfaces 6*b* and 6*a*, respectively. FIG. 7 illustrates a top plan view of the spike depicted in FIG. 6.

Figure 3:
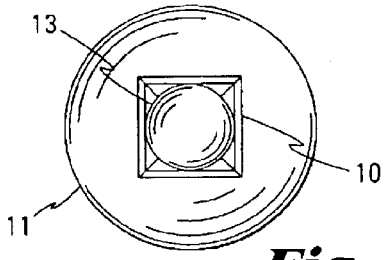
FIG. 3 is top plan view of a spike embodying the present invention.

In one embodiment of the invention, depicted in FIG. 2 and FIG. 3, the head 10 comprises a projecting polygonal tool grip extending axially from the flange on the side opposite to the threaded shank. In the embodiment depicted in FIGS. 6 and 7, the head 10 also comprises a projecting polygonal tool grip (shown in FIGS. 6 and 7 as 10*a*), which in this embodiment extends axially from the first flange 11*a* on the side opposite the spacer portion 18. Although the shape of the tool grip is not critical, it is generally adapted for engagement by a wrench to enable rotary driving of the spike into the tie or removal of the spike using a rotary motion imparted to the tool grip. It will be understood by those skilled in the art that a variety of equivalent structures may be substituted for the projecting polygonal tool grip without departing from the invention. Thus, for example, the head of the spike may comprise a generally polygonal recessed tool socket positioned on the flange on the side opposite to the threaded shank (or in the case of the embodiment shown in FIGS. 6 and 7, on the side of the first flange opposite to the spacer portion), wherein the recessed socket is preferably adapted for engagement with a socket wrench or socket driver to enable rotary driving of the spike into the tie or removal of the spike using a rotary motion imparted to the socket.

As shown in FIGS. 2, 3, 6 and 7, a hemispherical head 13 is preferably provided to permit driving of the spike into the tie using impact spike driving methods that apply a force to the head of the spike in the general direction of the spike tip. The hemispherical head 13 is preferably deformable by virtue of the material used to make the head, and is adapted to deform slightly under impact driving, thereby preventing damage to the tool grip that could prevent removal of the spike using a wrench.

Figure 4:
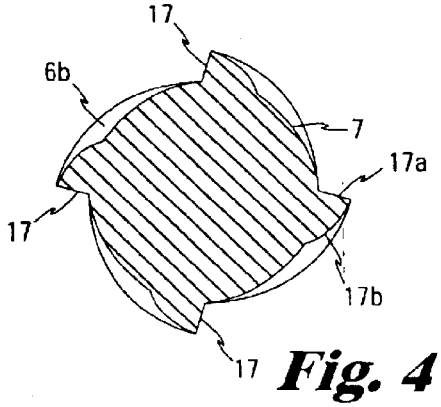
FIG. 4 is a fragmentary, transverse cross-sectional view of the shank portion of a spike embodying the present invention.

FIG. 4 shows a cross-sectional top view of the improved spike illustrating use of a substantially cylindrical shank defined by the flat lands 7, and the upper thread surface 6*b* of the pitched helical threads. FIG. 4 also shows a plurality of flutes 17. The flutes extend radially outward from the shank, and extend axially between the stand-off and the point at which the threads terminate on the shank. The position of a flute on the shank preferably corresponds to the termination point of a thread. In other words, the lower end of an individual flute (i.e. the flute end furthest from the stand-off) marks the upper termination point of an individual thread (i.e. the thread end furthest from the tip).

Because the flutes extend outward and away from the center of the shank, the flutes are adapted to resist removal of the spike by engaging with wood fibers once the spike is driven into the tie. Thus, when driving the spike into the tie, the leading edge 17*b* of each flute compresses and deforms the wood fibers of the tie. This permits the spike to be readily driven into the tie. Once driving is completed, however, the wood fibers of the tie relax and recover by filling in voids adjacent to the flutes that were created by the driving step. The trailing edge 17*a* of each flute thus acts to hold the spike or lock the spike into the tie with a force sufficient to resist loosening (i.e. turning out) of the spike due to working under load or due to the elements.

Figure 5:
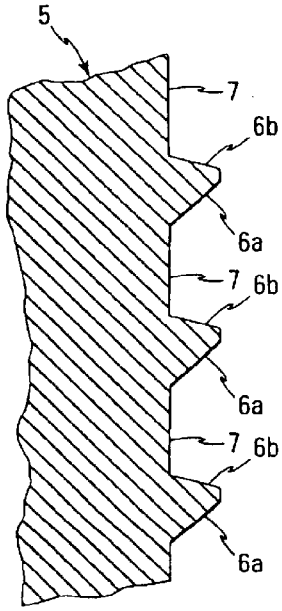
FIG. 5 is a fragmentary, transverse axial view of a spike embodying the present invention.

As shown in FIG. 5, the helical threads preferably have an upper thread surface 6*b* which defines an obtuse pitch angle relative to the nearest adjacent land 7 which is substantially closer to ninety degrees than the pitch angle defined between the lower thread surface 6*a* and the nearest adjacent 1 and 7. Because this preferred thread design allows the spike 1 to freely screw into the tie 9 when a force is applied to the head (i.e. the spike is driven), such a thread design is particularly well suited for use with automated spike driving equipment. Most preferred is automated impact spike driving equipment that drives the spike by applying a force to the spike head substantially in the direction of the tip of the shank. Suitable automated spike driving equipment includes the Nordco Model 99C spike driver (Nordco, Inc., Milwaukee, Wis.), Fairmont Tamper Model W96 (Fairmont Tamper, a Division of Harsco Track Technologies, Company, West Columbia, S.C.) or the like.

In addition, the preferred thread design allows the spike 1 to be readily driven using hand operated impact spike driving equipment such as hammers, sledges, mauls, or power-driven/hand operated spike drivers such as the Ingersol Rand Spike Driver Model MX60, (Ingersol Rand, Inc.), Ingersol Rand Spike Driver Model MX 90 (Ingersol Rand, Inc.), or the like.

Preferably, the pitched helical threads 6 are adapted to permit driving of the spike 1 into the tie 9 using a generally clockwise rotary motion applied to the tool grip, and to permit removal of the spike 1 from the tie 9 using a generally counter-clockwise rotary motion applied to the tool grip. Both clockwise and counterclockwise directions refer to the rotational direction of the tool grip when viewing the spike from the side of the flange opposite to the shank.

Alternatively, the threads 6 are adapted to permit driving of the spike 1 into the tie 9 using a generally counter-clockwise rotary motion applied to the tool grip, and to permit removal of the spike 1 from the tie 9 using a generally clockwise rotary motion applied to the tool grip.

The improved spike is generally used with a metal tie plate or fishplate 12 to secure the rail 18 to the tie 9. If a fishplate is used, the fishplate preferably comprises a metal boss or elastic fastener 16 adapted to engage with the flange 14 of the rail, and a cavity into which the shank of the spike may be inserted to permit driving of the spike into the tie. As shown in FIG. 1, the rail flange 14 preferably rests on the tie plate or fishplate 12, and the tie plate or fishplate 12 preferably rests on the wooden tie 9.

FIG. 2 illustrates the use of the inventive spike 1 in combination with a metal fishplate 12 having a cavity 2, and a wooden tie 9. Preferably, the tie 9 also has a cavity 13 to accommodate the shank 5 of the inventive spike. Preferably, the stand-off 15, the threaded shank 5, the fishplate cavity 2 and the tie cavity 13 are all substantially cylindrical. The fishplate cavity 2 has a diameter A greater than or equal to the diameter E of the stand-off 15, and preferably has a diameter A greater than or equal to the diameter F of the threaded shank 5. In a preferred embodiment, a substantially cylindrical cavity 13 having a diameter B is formed in the tie 9 before inserting the tip 8 of the spike 1. In this preferred embodiment, the diameter B of cavity 13 is less than the diameter F of the threaded shank.

It will be understood by those skilled in the art that the diameter and overall length of the spike are not critical, and may be varied according to the dimensions of the tie and-tie plate or fishplate. Even though the overall length of the spike is not critical and may be any suitable length, this length is generally in the range of 15–25 cm. However, the length D of the stand-off 15 must be adapted to ensure that the flutes 17 are at least partially engaged with the wooden tie 9 when the spike 1 is driven into the tie 9. This ensures that the flutes 17 are locked into engagement with the wooden tie 9 with a force sufficient to prevent or reduce the tendency for the spike to loosen under the load of passing railroad locomotives and rolling stock (not shown). Preferably, the length D of the stand-off 15 is at least as long as the length C of the cavity in the fishplate 12, thereby ensuring that the flutes 17 are fully-engaged with the wooden tie. Most preferably, the length of the stand-off is between about 2 cm to 5 cm.

Notwithstanding the improvements embodied in the present invention, it will be understood by those skilled in the art that it may be necessary to replace components of a railroad track assembly due to damage or wear. Such replacement will generally require the removal of one or more spikes. It is understood that some damage to the wooden tie may occur due to repeated removal or installation of improved spikes of the present invention. An aspect of the present invention therefore involves removal of an improved spike having a first stand-off length, and replacement with an improved spike having a second, longer stand-off length, in order to ensure that the flutes of the replacement spike engage wood fibers that are substantially undamaged by the flutes of the removed spike.

Figure 8:
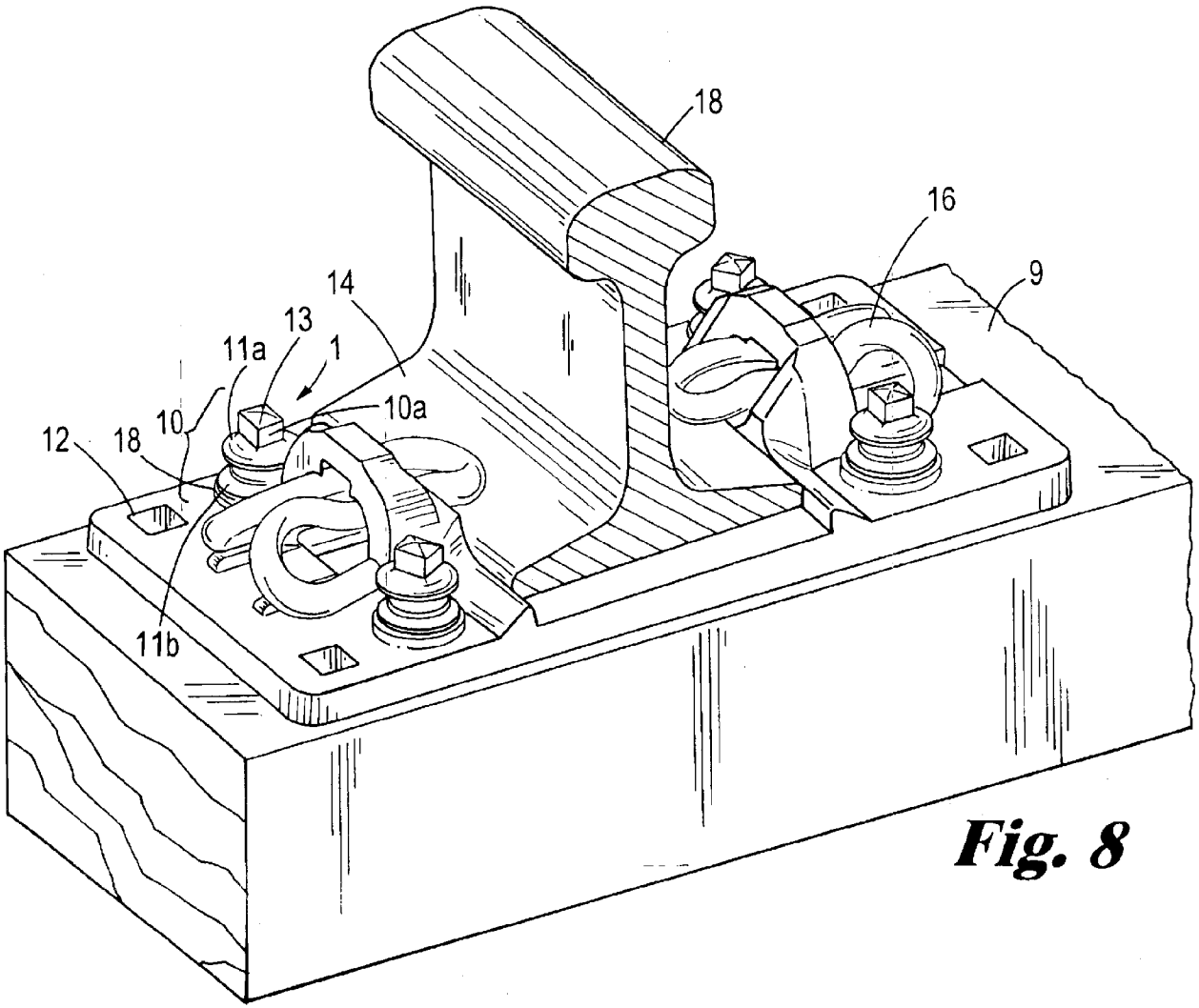
FIG. 8 is a perspective view of a typical metal to wood fastening application embodying the present invention.

The head design of the spike depicted in FIGS. 6 and 7 aids in the removal of the spike. The two flanges 11*a* and 11*b*, and the spacer portion 18 allow for a claw or other automated or manual tool to engage or grip the spike and remove it. The flanges 11*a* and 11*b* preferably are circular, but may be of any shape suitable for the intended application. As shown in FIGS. 6 and 7, the diameter of second flange 11*b* is preferably greater than the diameter of first flange 11*a*, spacer portion 18 may be of any suitable length or shape for an intended application. In one embodiment, the spacer portion is circular in a cross-section perpendicular to the longitudinal axis of the spike, and is about ⅜ of one inch in length. When installed (as illustrated in FIG. 8), the head 10, having two flanges as shown in FIGS. 6 and 7, will be exposed for use with a claw or other automated or manual tool to remove the spike 1. The surface of second flange 11*b* on the side opposite the spacer portion 18 will sit on the fishplate 12 if a fish plate is used (see FIG. 8), and the first and second flanges 11*a* and 11*b*, separated by spacer portion 18, will be above the fishplate.

Preferably, the spike comprises a metal. Although the spike may be made of any number of metals or metal alloys, ferrous metals such iron or steel are preferred. Ferrous metals are preferred for use with an automated spike driving apparatus, since magnetic forces may then be used to hold the spike in operational engagement with the driving device.

Another aspect of this invention provides an improved railroad track assembly. The assembly comprises a metal rail, a wooden tie, a metal tie plate adapted to engage the rail, and an improved spike of the present invention. The improved spike is described in the previous detailed description of the invention and in FIGS. 1-7.

In an embodiment of this improved track assembly, the improved spike is driven into a wooden tie to secure a metal rail and a metal tie plate to the tie. The tie plate is adapted to engage the rail at the rail flange. The improved spike comprises a head having an annular flange (or in the case of the embodiment depicted in FIGS. 6 and 7, a head having first and second axially spaced flanges), a stand-off extending axially from the flange (in FIG. 6 embodiment, extending from the second flange 11*b*), a plurality of flutes extending axially from the stand-off, and a shank extending axially from the flutes to form a tapered tip. The flutes are adapted to engage the wooden tie. The stand-off has a length adapted to ensure that the flutes are at least partially embedded in the tie when the spike is used to fasten the tie plate and the rail to the tie.

In a preferred variation of this embodiment, the shank, further comprises a plurality of helical, generally parallel threads extending over at least a portion of the shank, running from the flutes to the tip. In one variation of this preferred embodiment, the threads are adapted to permit driving of the spike into the tie using an impact driving method, and to permit easy removal of the spike using a wrench or other rotary spike removal method. The threads are generally parallel, helical threads extending from the flutes over at least a portion of the shank in the direction of the tip. The threads are adapted to cause rotation of the spike into the tie during installation using automated or manual impact spike-driving methods. In other words, the helical threads are preferably adapted to screw the spike threads into the wooden tie when a force is applied to the head of the spike in a direction generally towards the spike tip.

In another variation of this preferred embodiment, the spike head is adapted for use with impact spike-driving methods. The head of the spike is preferably hemispherical or dome shaped and is adapted to for use with manual or automated impact spike-driving methods. Preferably, the hemispherical head is adapted to deform slightly under impact driving, thereby preventing damage to the tool grip.

The present invention also provides a method of using an improved railroad spike to secure a metal rail and a metal tie plate to a wooden tie. The improved spike is described in the preceding detailed description of the invention and in FIGS. 1-7. The improved method comprises the step of driving the improved spike into the tie to secure the rail and the tie plate to the tie. The tie plate is adapted to engage the rail at the rail flange. The tie plate preferably comprises a metal boss or elastic fastener (i.e. an e-clip) that engages the rail flange when the improved spike of the present invention is driven into the tie, thereby securing the tie plate and the rail to the tie.

In a preferred embodiment, the tie plate comprises a cavity into which the tip of the spike shank is inserted before the spike is driven into the tie. The improved spike of the present invention is preferably driven into the tie until the spike flange engages with the tie plate and the metal flutes of the spike at least partially engage the wood of the tie. In the usual case, a hole or cavity (i.e. a pilot hole) is bored into the wooden tie before the spike tip is inserted into the tie plate cavity and the spike is driven into the hole or cavity of the tie. Preferably, the hole or cavity bored in the wooden tie has a diameter smaller than the diameter of the shank of the improved spike.

In a preferred embodiment, a driving device is used to drive the spike into the tie, thereby securing the metal rail to the wooden tie. Generally, the driving device may be either an impact driver, such as a hammer, sledge, or maul; or a rotary driver, such as an open-end wrench, box end wrench, socket wrench, or socket driver. Preferably, an automated impact spike-driving method is employed.

Other embodiments of the invention are within the scope of the following claims.

What is claimed is:

1. A metal to wood fastening spike, comprising:

(a) a head having an first and second annular flanges;

(b) a stand-off extending axially from said second flange;

(c) a plurality of flutes extending axially from said stand-off, said flutes being adapted to engage wood; said stand-off having a length adapted to ensure that said flutes are at least partially embedded in wood when said spike is used to fasten metal to wood; and (d) a shank extending axially from said flutes to form a tapered tip, said shank further comprising a plurality of helical, generally parallel threads extending over at least a portion of said shank, running from said flutes to said tip.

2. A spike according to claim 1, comprised of metal.

3. A spike according to claim 1, wherein said shank is cylindrical.

4. A spike according to claim 1, wherein said first and second flanges are circular.

5. The spike according to claim 4, wherein said second flange has a diameter greater than the diameter of said first flange.

6. The spike according to claim 1, comprising a spacer portion between said first and second flanges.

7. The spike according to claim 6, wherein said spacer portion is circular.

8. The spike according to claim 6, wherein said spacer portion has a length of about three-eights of one inch.

9. A spike according to claim 1, wherein said head comprises a hemispherical surface opposite to said first flange, said surface adapted for driving said spike.

10. A spike according to claim 1, wherein said head comprises a projecting polygonal tool grip opposite to said first flange, said tool grip adapted to engage with a wrench.

11. A spike according to claim 1, wherein said length of said stand-off is between about 2 cm to 5 cm.

12. A spike according to claim 1, wherein said threads are adapted to cause rotation of said spike into wood when a force is applied to said head of said spike.

13. A spike according to claim 12, wherein said threads are adapted to cause rotation of said spike into wood when a force is applied to said head of said spike in a direction towards said tip.

14. A railroad track assembly comprising a metal rail, a wooden tie, a metal tie plate adapted to engage said rail, and a spike driven into said tie, said spike adapted to fasten said tie plate and said rail to said tie, said spike further comprising:

(a) a head having first and second annular flange;

(b) a stand-off extending axially from said second flange;

(c) a plurality of flutes extending axially from said stand-off, said flutes being adapted to engage wood; said stand-off having a length adapted to ensure that said flutes are at least partially embedded in said tie when said spike is used to fasten said tie plate to said tie; and (d) a shank extending axially from said flutes to form a tapered tip, said shank further comprising a plurality of helical, generally parallel threads extending over at least a portion of said shank, running from said flutes to said tip.

15. An assembly according to claim 14, wherein said head of said spike comprises a hemispherical surface opposite to said first flange, said surface adapted for driving said spike.

16. An assembly according to claim 14, wherein said head of said spike comprises a projecting polygonal tool grip opposite to said first flange, said tool grip adapted to engage with a wrench.

17. An assembly according to claim 14, wherein said length of said stand-off is between about 2 cm to 5 cm.

18. An assembly according to claim 14, wherein said threads are adapted to cause rotation of said spike into said wooden tie when a force is applied to said head of said spike.

19. An assembly according to claim 18, wherein said threads are adapted to cause rotation of said spike into said wooden tie when a force is applied to said head of said spike in a direction towards said tip.

20. A method of using a railroad spike, comprising:

(a) providing a railroad spike comprising a head having first and second annular flanges, a stand-off extending axially from said second flange, a plurality of flutes extending axially from said stand-off, and a shank extending axially from said flutes to form a tapered tip, said shank further comprising a plurality of helical, generally parallel threads extending over at least a portion of said shank running from said flutes to said tip;

(b) providing a wooden tie, a metal rail, and a fishplate adapted to engage with said rail and said tie; and (c) driving said spike into said tie until said flutes are at least partially embedded in said tie, and said fishplate is engaged with said rail.

21. The method of claim 20, wherein said fishplate further comprises a metal boss, and said boss is adapted to hold said rail onto said tie.

22. The method of claim 20, wherein said fishplate comprises a top face, a lower face, and a cavity having a length extending between said top face and said lower face.

23. The method of claim 22, wherein said stand-off is at least as long as said cavity.

24. The method of claim 22, wherein said stand-off has a length between 2 and 5 cm.

25. The method according to claim 22, wherein said cavity is circular, and said stand-off is cylindrical.

26. The method according to claim 25, wherein the diameter of said circular cavity is greater than the diameter of said stand-off.

27. The method of claim 20, further comprising the step of boring a hole in said tie before driving said spike into said hole in said tie.

28. The method of claim 20, wherein driving comprises engaging a driving device with said head.

29. The method of claim 28, wherein said driving device is an automated spike driver.

30. The method of claim 29, wherein said driving device is an automated impact spike driver.

31. The method of claim 28, wherein said driving device is power driven and hand operated.

32. The method of claim 28, wherein said driving device is selected from the group consisting of impact drivers and rotary drivers.

33. The method of claim 32, wherein said driving device is an impact driver selected from the group consisting of hammers, sledges, and mauls.

34. The method of claim 28, wherein said driving device applies a force to said head of said spike directed towards said tip.

35. The method of claim 28, wherein said driving device is adapted to hold said spike in operational engagement with said driving device.

36. The method of claim 35, wherein said driving device is magnetic, and magnetic forces operate to hold said spike in operational engagement with said driving device.

37. A metal to wood fastening spike, comprising:

(a) a head having at least one annular flange;

(b) a stand-off extending axially from said flange;

(c) at least one flute extending axially from said stand-off, said flute being adapted to engage wood; said stand-off having a length adapted to ensure that said flute is at least partially embedded in wood when said spike is used to fasten metal to wood; and (d) a shank extending axially from said flute to form a tapered tip, said shank further comprising a plurality of helical, generally parallel threads extending over at least a portion of said shank, running from said flute to said tip.

38. A spike according to claim 37, further comprising first and second annular flanges.

* * * * *